US008105087B2

(12) United States Patent
Valentini

(10) Patent No.: US 8,105,087 B2
(45) Date of Patent: Jan. 31, 2012

(54) SYSTEM FOR DETECTING AND RECORDING IMPACTS PRODUCED BY SHOCK WAVES AND PROJECTILES ON A TARGET

(75) Inventor: Stefano Valentini, Lugano (CH)

(73) Assignee: Cybergun S.A., Bondoufle (FR)

( * ) Notice: Subject to any disclaimer, the term of this patent is extended or adjusted under 35 U.S.C. 154(b) by 1172 days.

(21) Appl. No.: 11/579,159

(22) PCT Filed: May 4, 2004

(86) PCT No.: PCT/IB2004/001529

§ 371 (c)(1),
(2), (4) Date: Oct. 31, 2006

(87) PCT Pub. No.: WO2004/102106

PCT Pub. Date: Nov. 25, 2004

(65) Prior Publication Data

US 2007/0241919 A1 Oct. 18, 2007

(30) Foreign Application Priority Data

May 15, 2003 (CH) ..... 0856/03
Feb. 17, 2004 (CH) ..... 0244/04

(51) Int. Cl.
*F41A 33/00* (2006.01)

(52) U.S. Cl. ..... 434/11; 434/12

(58) Field of Classification Search ..... 434/11–29; 273/376, 372, 348.5; 482/4; 463/5; 73/126; 364/423

See application file for complete search history.

(56) References Cited

U.S. PATENT DOCUMENTS

| | | | | |
|---|---|---|---|---|
| 4,088,315 | A | 5/1978 | Schemmel | |
| 5,029,873 | A | 7/1991 | Davis | |
| 5,354,057 | A * | 10/1994 | Pruitt et al. | 463/5 |
| 5,716,302 | A * | 2/1998 | Andersson | 482/84 |
| 6,367,800 | B1 * | 4/2002 | Sheck et al. | 273/372 |
| 6,604,946 | B2 * | 8/2003 | Oakes | 434/11 |
| 2002/0064760 | A1 * | 5/2002 | Lazecki et al. | 434/11 |

FOREIGN PATENT DOCUMENTS

| | | |
|---|---|---|
| DE | 27 41 090 | 3/1979 |
| EP | 0 037 654 | 12/1982 |
| EP | 0 349 214 | 1/1990 |
| GB | 2 198 046 | 6/1988 |
| WO | WO 02/103654 | 12/2002 |

* cited by examiner

*Primary Examiner* — Xuan Thai
*Assistant Examiner* — Timothy A Musselman
(74) *Attorney, Agent, or Firm* — Young & Thompson

(57) ABSTRACT

A system (1) for detecting and recording impacts produced by shock waves and/or by non-lethal projectiles on the surface of a target (2), includes: a) a plurality of sensors (3*i*) applied to the target (2) and capable of detecting the said impacts and generating and transmitting a signal detectable by a transceiver device (4); b) a transceiver device (4), also fixed to the target (2), and capable of receiving the signals generated by the said sensors (3*i*), detecting which of the sensors has emitted a signal, and sending the corresponding data to a recording apparatus (5); c) a recording apparatus (5) capable of recording and storing the data received from the transceiver device (4).

9 Claims, 1 Drawing Sheet

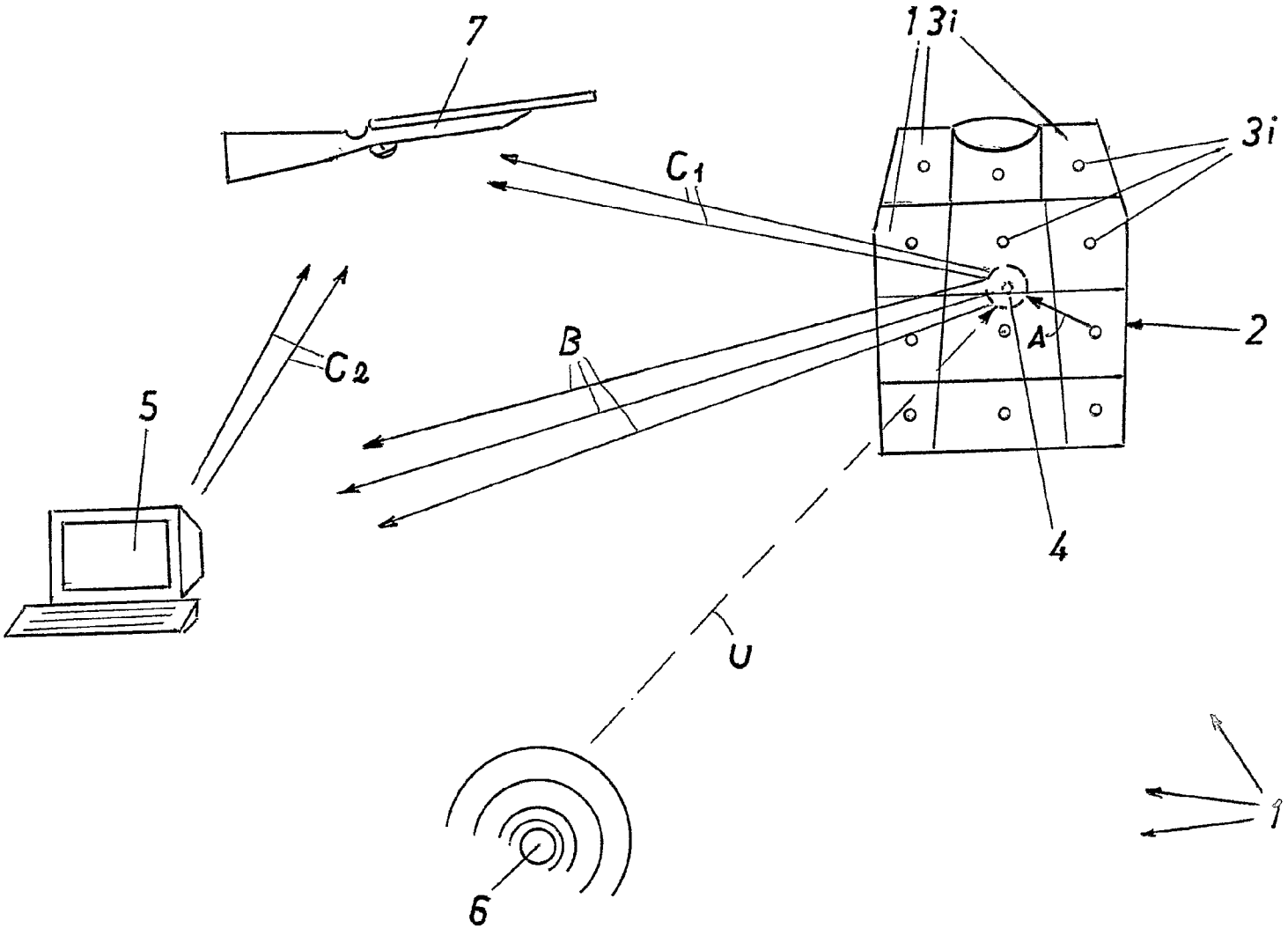
3i
2
1
4
A
13i
C1
U
B
7
6
C2
5

SYSTEM FOR DETECTING AND RECORDING IMPACTS PRODUCED BY SHOCK WAVES AND PROJECTILES ON A TARGET

The present invention relates to systems and apparatus used in simulated combats and in training courses for the armed forces and the police.

At the present time, in the aforesaid courses and combats, use is made of weapons which fire non-lethal projectiles which hit the targets (usually the bodies of the participants) without inflicting physical damage, simply "marking" their point of impact with dyes.

However, this procedure has various drawbacks. In the first place, the use of the aforesaid dyes makes it necessary to wash the targets and the surrounding objects after each session of activity.

In the second place, the impact of a non-lethal projectile is sometimes so limited that it does not cause the emission of the dyes, and the effects of the simulated combat cannot be correctly detected, since the person constituting the target which is hit is not always able or willing to recognize that he has been hit.

In the third place, moreover, the known type of system and apparatus cannot be used to simulate the effects of the explosion of explosive devices, since there is no conceivable way of making one of these in such a way that its explosion (which in any case could not be allowed to create hazards for the onlookers) would cause the projection of a quantity of dyes that could simulate its effects.

The inventor of the solution according to the present application has devised a system which is simple to implement and can overcome all the above drawbacks.

This is because he has devised a system in which a plurality of sensors, distributed over the surface of each target, can detect the impact caused by a non-lethal projectile of the type described above in the area in which they are applied, transmitting a signal to a transceiver device which in turn sends it by a radio or cable link to a recording apparatus which can record and store the data sent to it by the aforesaid transceiver device.

Above all, the system according to the invention facilitates the running of debriefing sessions in which the recorded data can be analysed, possibly in terms of their temporal sequence, which can be determined easily by known systems, and the participants can be instructed about the best tactics to use, the ways of avoiding any mistakes that have been committed, and so on.

This recording apparatus can comprise a receiving apparatus which receives the aforesaid data and then sends them, in a suitably converted form, to an ordinary computer provided with a program which enables it to record them, store them, and display them on an image which represents a target and the areas of the target which has been affected by an impact or a simulated shock wave.

The said sensors, which can be of the piezoelectric type, generate in this case, when hit, potential differences which are easily transmitted to the said transceiver device.

The present invention therefore proposes a system for detecting and recording impacts produced by shock waves and/or by non-lethal projectiles as described in the attached Claim 1.

A more detailed description of a preferred embodiment of the system according to the invention will now be given, with reference to the attached figure, which shows a schematic overall view of the system.

The drawing shows how, in a system 1 according to the invention, the target consists of a jacket 2 over whose surface is distributed a plurality of piezoelectric sensors 3*i*, connected to a transceiver device 4 (also applied to the jacket and preferably inside it) in such a way that they transmit to the device (arrow A) the tension waves generated in them by the effect of an impact.

To enable the whole of the target 2 to be covered by the action of the sensors 3*i*, the inventor proposes, as shown in the drawing, that they be applied on rigid plates 13*i*, which can be made from ordinary Perspex and which can transmit to the sensors 3*i* the vibrations caused by the impact of a non-lethal projectile in the areas which they occupy.

As stated above, when an impact occurs on one of the said plates 13*i*, the corresponding sensor 3*i* sends voltage signals to the transceiver which transmits them in the form of radio waves (arrows B) to a recording apparatus 5, which can be located in a position remote from the site of the simulated combat or the training course.

The recording apparatus 5, whose receiving part receives the said radio signals from the transceiver device 4, transfers the signals, suitably converted, to a computer, which records the received data, stores them, and displays them on a screen on which is reproduced the jacket 2 on which the impact has occurred.

Thus at the end of each working session it is possible to access a clear and unambiguous image of the effects caused on the various participants in the course of the simulated combat which has been carried out.

The system 1 according to the invention can also be suitable for other uses, providing an advantageous versatility of application.

For example, if the simulated combat is carried out with electrically operated weapons, for example a rifle 7, the components of the system can be designed in such a way that the impact of a projectile on one or more sensors has the additional effect of disabling the said rifle, thus simulating the effects of the physical elimination of the person who has been hit.

This disabling can be carried out, again via a radio link, indicated by the arrows $C_1$, $C_2$, by the transceiver device 4 and/or by the recording apparatus 5.

Another possibility offered by the system according to the invention consists, as mentioned previously, in the simulation of the effects of the explosion of an explosive device such as a mine, a grenade, or the like.

To achieve this it is simply necessary to include in the system according to the invention one or more transmitters 6, which can be distributed in the simulated combat area, buried, or thrown, and so on, these transmitters, when activated, emitting a signal, detectable by the said transceiver device 4, which in terms of range and intensity simulates the effects produced by the explosion of the explosive devices for which they are a substitute.

When the shock wave, simulated for example by a train of radio waves, reaches the said transceiver device (arrows U), this retransmits a signal to the recording apparatus 5, which records and stores data corresponding to the effects of an explosion which is considered to have hit the person wearing the jacket 2 struck by the simulated shock wave.

In the case described, the target 2, being a jacket worn by a participant, is mobile, and its transceiver apparatus 4 communicates with the recording apparatus 5 by a radio link, as stated. If the target is fixed, this communication can also take place via a cable, conducting wires, or the like.

The inventor considers it unnecessary to provide specific details of the type of physical and electronic components to be used to achieve the operation of the system according to the invention as described above, since all persons skilled in the relevant art will have no difficulty in selecting from the wide range available on the market for similar or related applications.

The invention claimed is:

1. A system (1) for detecting and recording impacts on the surface of a wearable mobile target (2), comprising:

a plurality of sensors (3*i*) applied to an outer surface of the wearable mobile target (2) and capable of detecting said impacts produced by at least one of shock waves and non-lethal electrically inert projectiles and generating and transmitting a signal detectable by a transceiver device (4);

a transceiver device (4) fixed to said mobile wearable target (2), and capable of receiving the signals generated by said sensors (3*i*), detecting which of said sensors has emitted a signal, and sending the corresponding data to a recording apparatus (5);

a recording apparatus (5) remote from said wearable mobile target capable of recording and storing the data received from said transceiver device (4);

said recording apparatus (5) is provided with a display for displaying the data sent to said recording apparatus (5) by said transceiver device (4) on an image reproducing the profile of said wearable mobile target (2) and the positions of said sensors (3*i*) on said wearable mobile target(2).

2. The system according to claim 1, additionally comprising one or more transmitters (6) for sending a signal, detectable by said transceiver device (4), which in terms of range and intensity simulates the effects of the explosion of an explosive device.

3. The system according to claim 2, wherein said non-lethal electrically inert projectiles are fired by an electrically operated rifle (7), wherein at least one of said transceiver device (4) and said recording apparatus (5) are provided with means for disabling said rifle (7) when one or more sensors (3*i*) of said wearable mobile target (2) detect one or more impacts produced by a non-lethal projectile or by the simulated shock wave of an explosion.

4. The system according to claim 2, wherein said sensors (3*i*) are of the piezoelectric type, are distributed over the surface of a jacket (2), and are connected to the transceiver device (4) in such a way as to transmit to the transceiver device (4) the voltage which is generated in the jacket.

5. The system according to claim 1, wherein said non-lethal projectiles are fired by an electrically operated rifle (7), and at least one of said transceiver device (4) and said recording apparatus (5) are provided with means for disabling said rifle (7) when one or more sensors (3*i*) of said wearable mobile target (2) detect one or more impacts produced by said non-lethal projectile or by the simulated shock wave of an explosion.

6. The system according to claim 5, wherein said sensors (3*i*) are of the piezoelectric type, are distributed over the surface of a jacket (2), and are connected to the transceiver device (4) in such a way as to transmit to the transceiver device (4) the voltage which is generated in the jacket.

7. The system according to claim 1, wherein said sensors (3*i*) are of the piezoelectric type, are distributed over the surface of a jacket (2), and are connected to the transceiver device (4) in such a way as to transmit to the transceiver device (4)the voltage which is generated in the jacket.

8. The system according to claim 7, wherein each sensor (3*i*) is applied to a rigid plate (13*i*) fixed on the corresponding wearable mobile target (2).

9. The system according to claim 1, wherein the signals transmitted by the transceiver device (4) to said recording apparatus (5) are radio signals.

* * * * *